US007591386B2

(12) United States Patent
Hooper

(10) Patent No.: US 7,591,386 B2
(45) Date of Patent: Sep. 22, 2009

(54) MULTI-USE INTERMODAL CONTAINER

(76) Inventor: Robert C. Hooper, Box 183 RR#5 Spingfield Road, Winnipeg, MB (CA) R2C 2Z2

( * ) Notice: Subject to any disclaimer, the term of this patent is extended or adjusted under 35 U.S.C. 154(b) by 316 days.

(21) Appl. No.: 11/681,832

(22) Filed: Mar. 5, 2007

(65) Prior Publication Data

US 2007/0210080 A1 Sep. 13, 2007

Related U.S. Application Data

(60) Provisional application No. 60/780,068, filed on Mar. 8, 2006.

(51) Int. Cl.
*B65D 88/00* (2006.01)

(52) U.S. Cl. ..... 220/1.5; 298/27

(58) Field of Classification Search ..... 220/1.5; 105/240, 243; 298/24, 27
See application file for complete search history.

(56) References Cited

U.S. PATENT DOCUMENTS

| | | | | |
|---|---|---|---|---|
| 3,595,175 | A * | 7/1971 | Austill | 105/243 |
| 4,995,522 | A * | 2/1991 | Barr | 220/1.5 |
| 5,072,845 | A * | 12/1991 | Grogan | 220/1.5 |
| 2006/0043090 | A1 * | 3/2006 | Ferrini | 220/6 |

* cited by examiner

*Primary Examiner*—Harry A Grosso
(74) *Attorney, Agent, or Firm*—Ade & Company Inc; Ryan W. Dupuis; Kyle R. Satterthwaite

(57) ABSTRACT

A multi-use intermodal container for transporting cargo comprises compartments, each having both a hopper for discharging particulate material from the bottom of the compartments and a floor above the hopper for supporting standard freight thereon. The floor is arranged to allow passage of particulate material therethrough so that the compartments can be used either for bulk material transport or standard cargo/freight. A door in the side wall provides access to store cargo on the floor of the compartment and a roof hatch provides access to store bulk materials in the compartment for subsequent removal through the hopper.

14 Claims, 10 Drawing Sheets

MULTI-USE INTERMODAL CONTAINER

This application claims the benefit under 35 U.S.C. 119(e) of U.S. provisional application Ser. No. 60/780,068, filed Mar. 8, 2006.

FIELD OF THE INVENTION

The present invention relates to the movement of granulated and standard freight products, and more particular relates to a multi-use intermodal container for transporting either particulate material or pallet type freight.

BACKGROUND

Hopper style trucks, rail hopper cars and bulk shipping have commonly supported shipping of the granulated products, for example, grain, specials crops and other bulk items. The material handling between truck, rail cars and bulk ships tends to be costly, causes considerable material to be lost and is time consuming because of the resulting over handling of materials.

Common international trade routes involve use of box containers used to ship grain or seeds or other like materials from one continent or country to another in one direction with the box containers then being loaded with pallet type freight when returned in the other direction. Conventional box type containers however are typically not well suited for handling grain or other small particulate material, resulting in high cost or spoilage due to the awkwardness of transferring, loading or otherwise handling the material. Use of hopper containers are known for improving handling of particulate materials including grain and the like, however when used on a common trade route as noted above, the hopper containers must be returned empty as they are not suitable for receiving pallet type freight. Shipping of empty containers represents a further cost which is desired to be avoided.

SUMMARY

According to one aspect of the present invention there is provided a multi-use intermodal container comprising:

- a rectangular frame suitably sized and configured for stacking with conventional intermodal containers;
- at least one compartment supported on the frame, said at least one compartment comprising:
  - a top wall enclosing a top side of the compartment and locating a hatch opening therein;
  - a hatch cover for selectively closing the hatch opening;
  - a hopper enclosing a bottom side of the compartment, the hopper tapering downwardly and inwardly to a discharge opening;
  - a gate for selectively closing the discharge opening;
  - upright side walls extending between the hopper and the top wall;
  - and a floor spanning generally horizontally between the side walls above the hopper for supporting a load thereon, the floor being arranged to allow passage of particulate material therethrough; and
- at least one door supported in a respective one of the side walls for access to a hollow interior of said at least one compartment.

By combining a container including hopper discharges along with a floor which does not interfere with the use of the hopper discharge for particulate material but which can be used for supporting pallet type freight thereon provides a container which is suitably configured for maximizing efficiency when carrying either one of particulate material or pallet type freight. Accordingly shipping cost of shipping empty containers can be avoided while still taking advantage of improved handling characteristics of hopper containers.

The floor preferably comprises a grate including a plurality of through openings formed therein which spans between a bottom of the side walls and locates the hopper immediately below the floor. Accordingly, the side walls preferably extend substantially vertically upward from the floor. Preferably the door also extends upwardly from the floor.

Preferably the door is fully contained within a volume defined by a perimeter of the frame.

When there is provided a plurality of compartments, each preferably is rectangular in cross section and includes a hopper at a bottom end, a floor spanning above the hopper and at least one door in a respective one of the side walls thereof. Preferably a door is supported at each end of the frame.

When there is provided four compartments sequentially aligned with one another in a longitudinal direction of the frame, doors are preferably located along sides of the container in association with interior ones of the compartments.

The frame preferably extends along a full rectangular perimeter about the hopper of the compartments.

The container may be provided in combination with a container carrying railcar having a deck upon which the frame of the container is supported in which the hopper of said at least one compartment is supported above the deck of the railcar.

According to another aspect of the present invention there is provided an intermodal container comprising:

- a plurality of compartments including:
  - a bottom shaped hopper tapering down and inward to a chute opening;
  - a gate operating device to selectively open and close the chute opening;
  - an opening at the top of each compartment which can be closed or opened with an operating covering;
  - a set of doors with locking devices at the ends in association with compartments at the ends of the container and along sides of the container in association with middle ones of the compartments;
  - a floor even with the bottom of the doors, which allows the bulk material to discharge through the bottom chutes and allows the loading of standard freight through the doors; and
- a frame work surrounding said at least one or more compartments for supporting the container, the frame being compatible and standard to other intermodal containers and the like.

The container according to the present invention permits the storage, transportation and consistency of the bulk materials or other standard freight or materials transported by truck, to rail, to domestic customers and/or to ship yards for international shipments. Accordingly once the product is in the container there is no need for transferring and/or handling of this product for each movement will be on the container.

Some embodiments of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
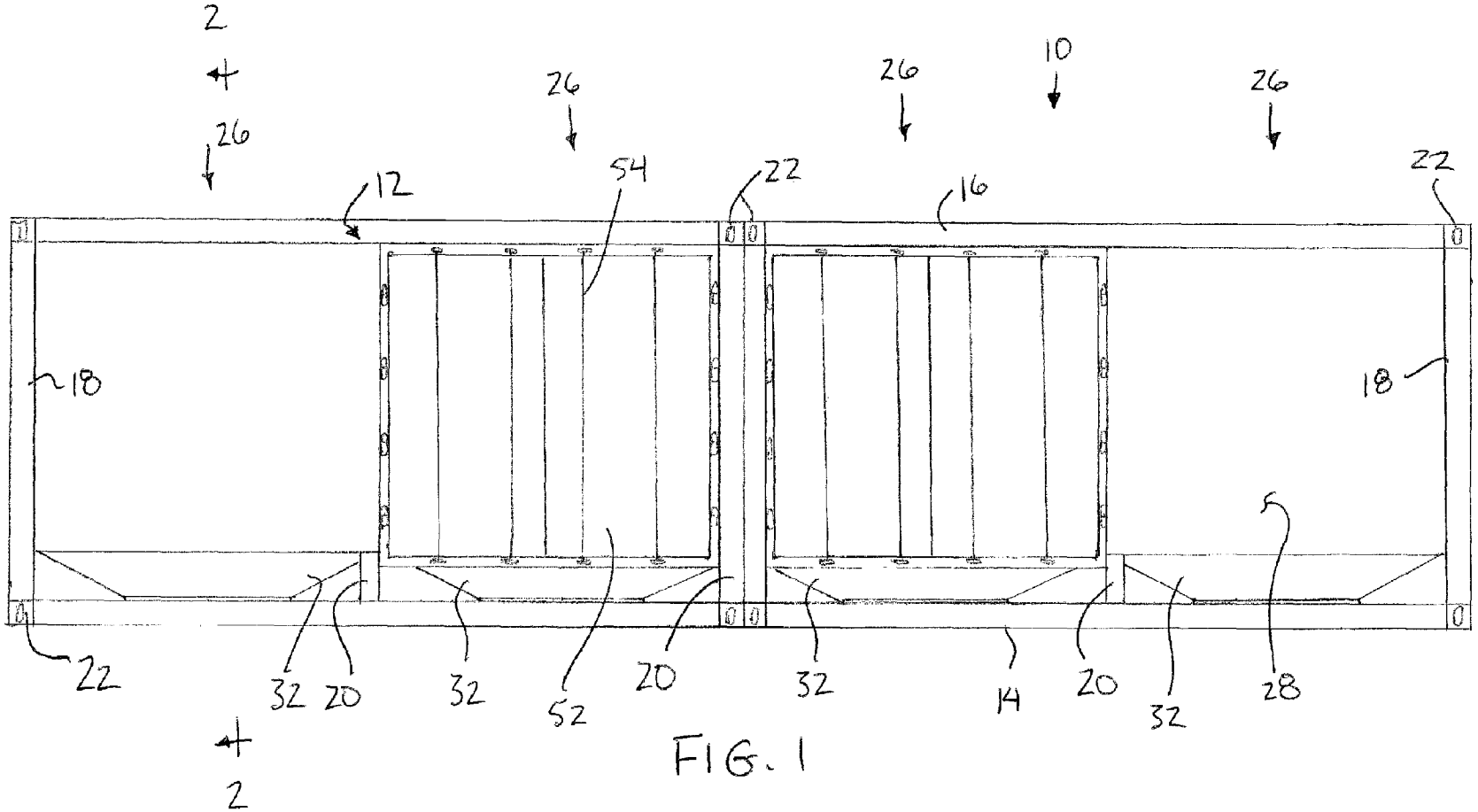
FIG. 1 is a side elevational view of a first embodiment of the container.
Figure 3:
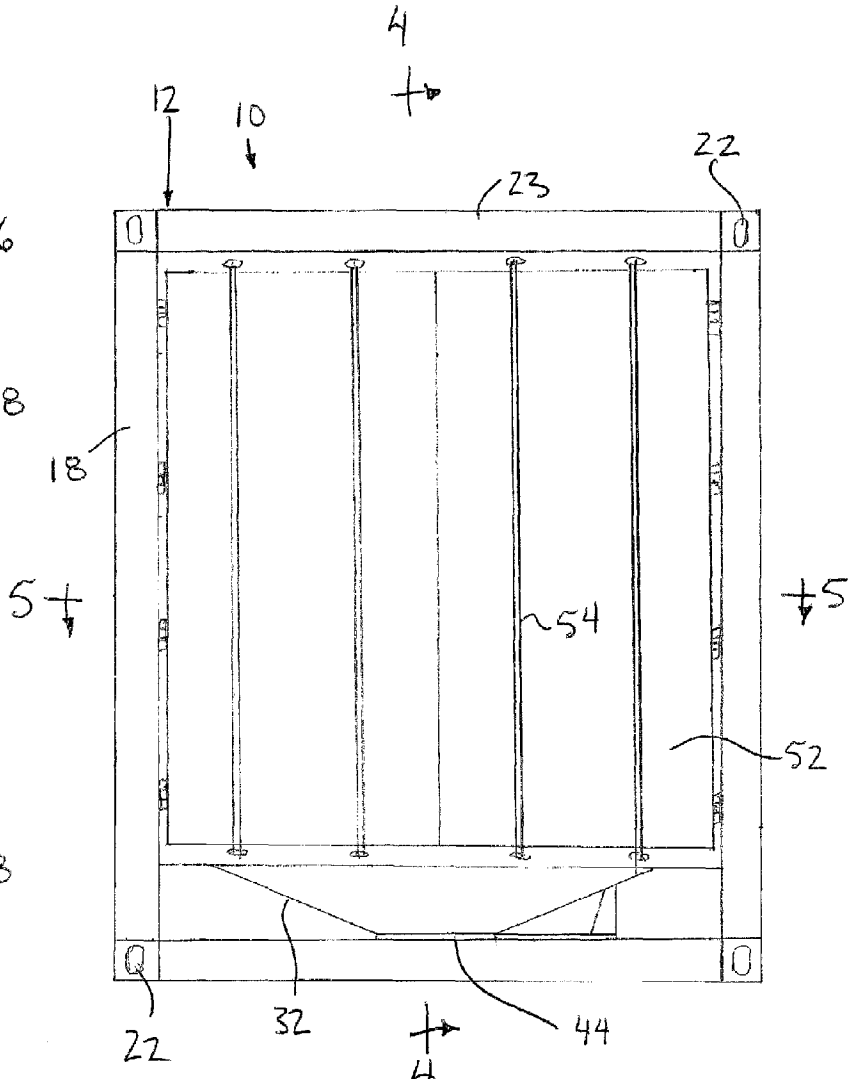
FIG. 3 is an end elevational view of the first embodiment.
Figure 2:
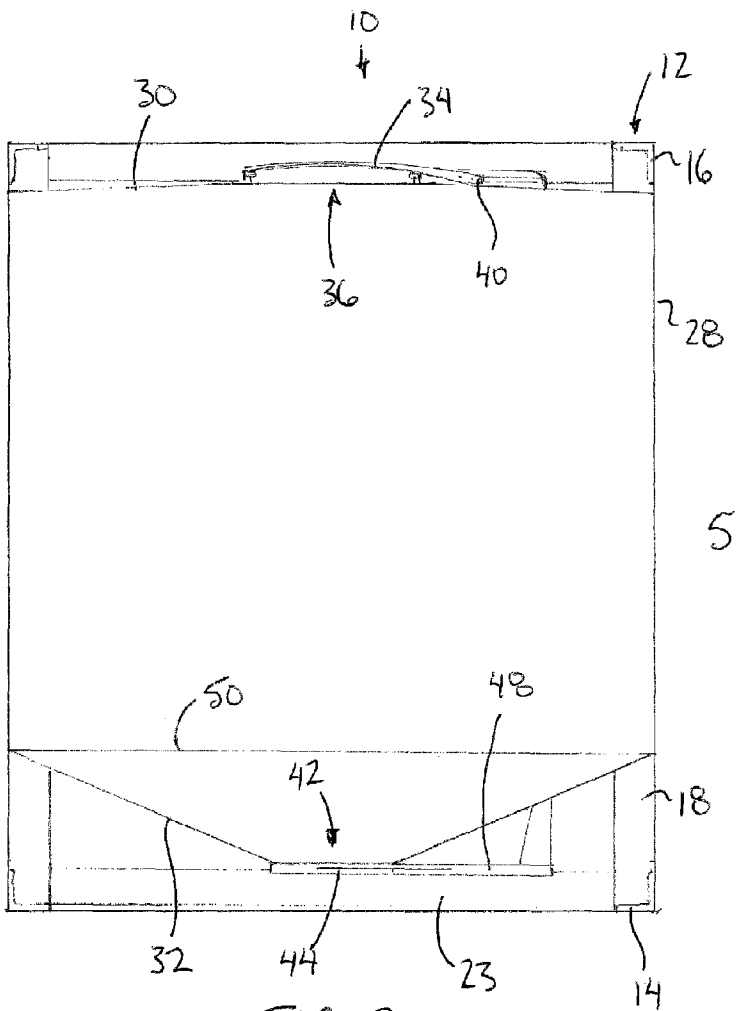
FIG. 2 is a sectional view along the line 2-2 of FIG. 1.
Figure 4:
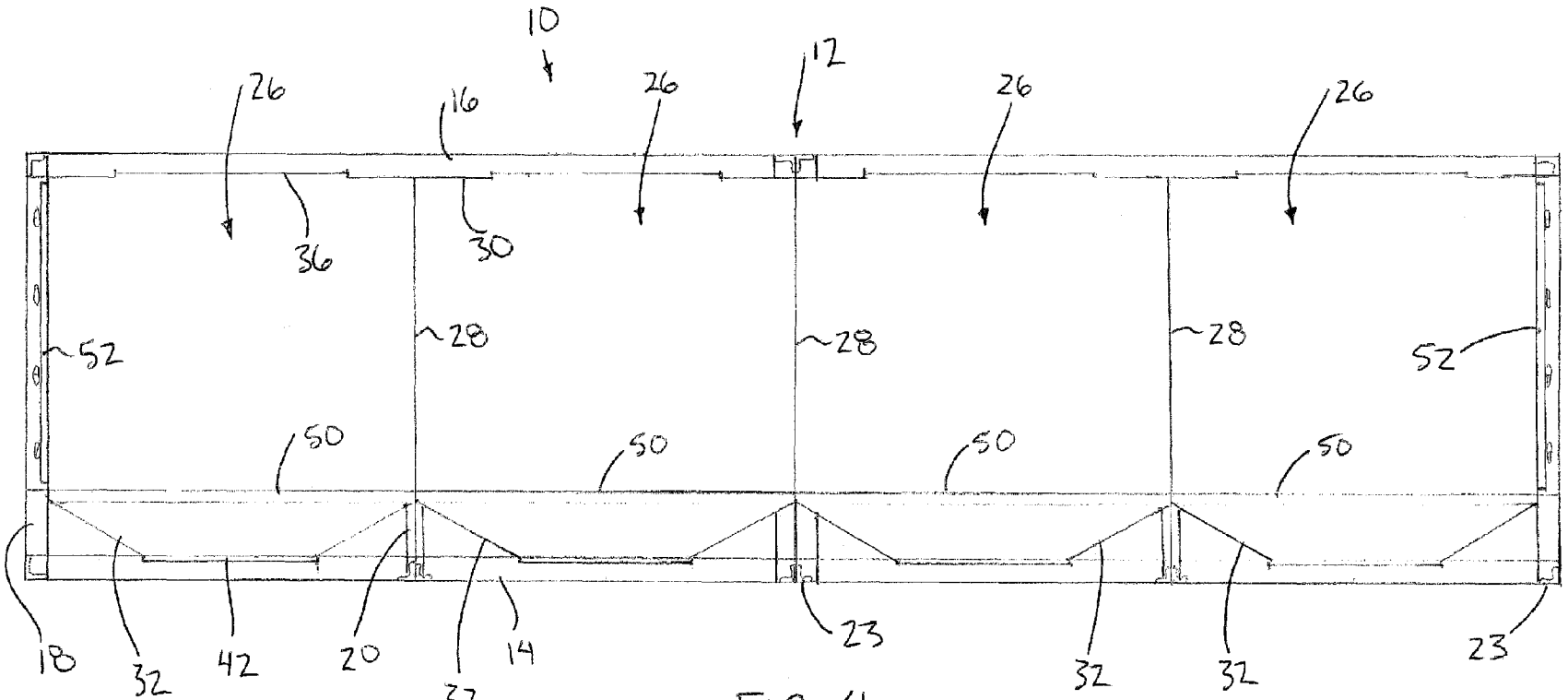
FIG. 4 is a sectional view along the line 4-4 of FIG. 3.
Figure 5:
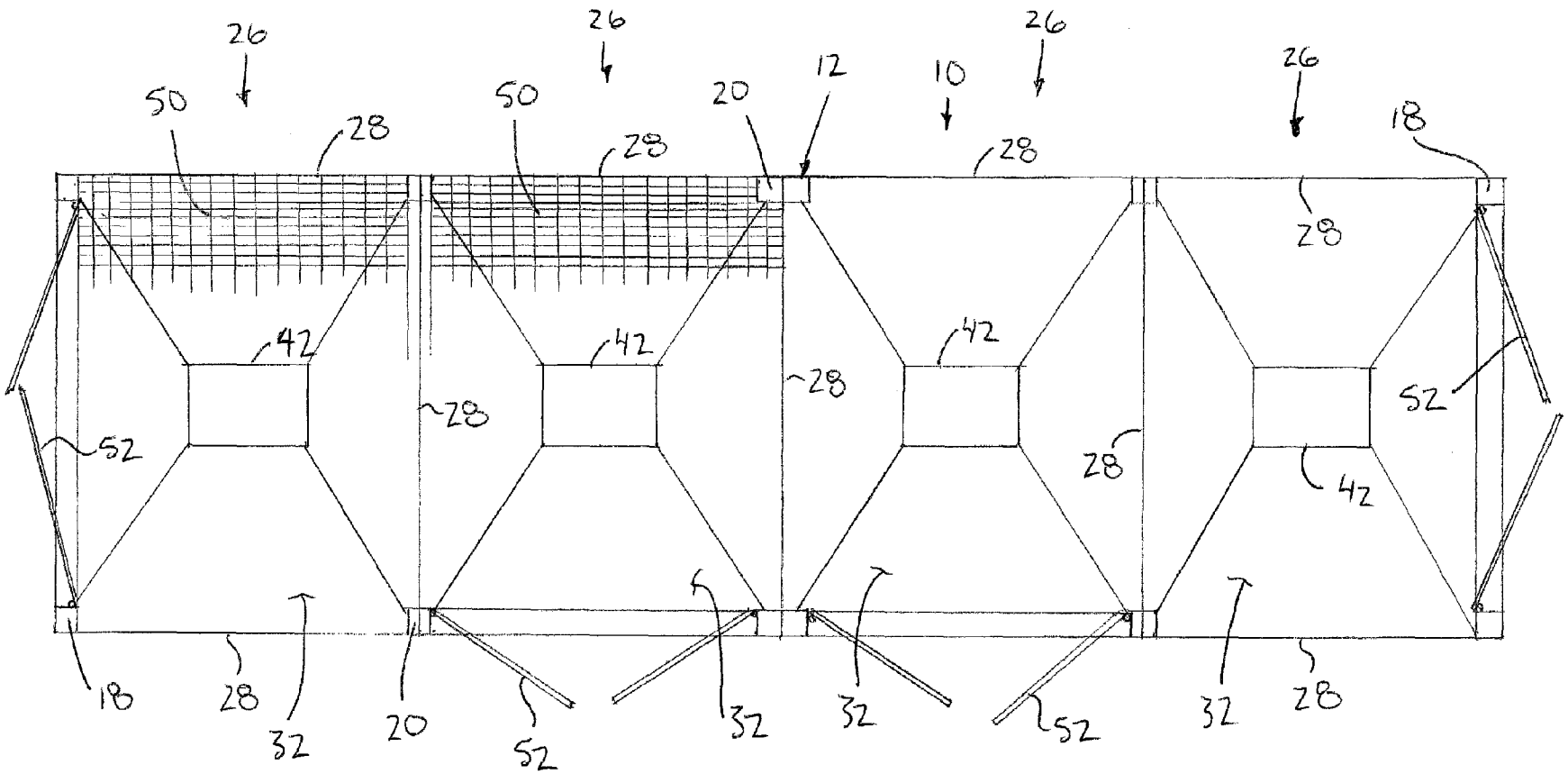
FIG. 5 is a sectional view along the line 5-5 of FIG. 3 in which the floor is shown partially removed.
Figure 6:
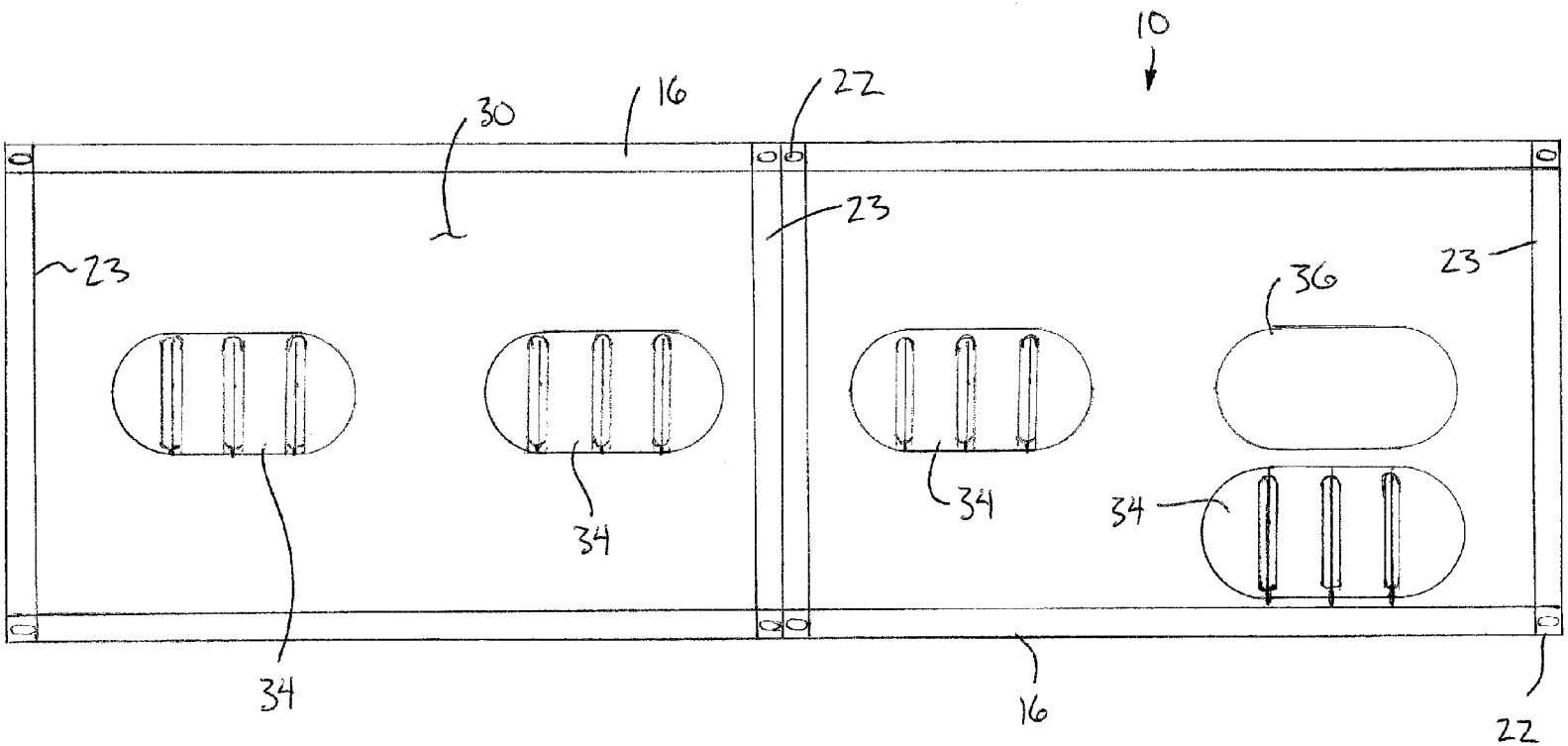
FIG. 6 is a top plan view of the container according to FIG. 1.
Figure 7:
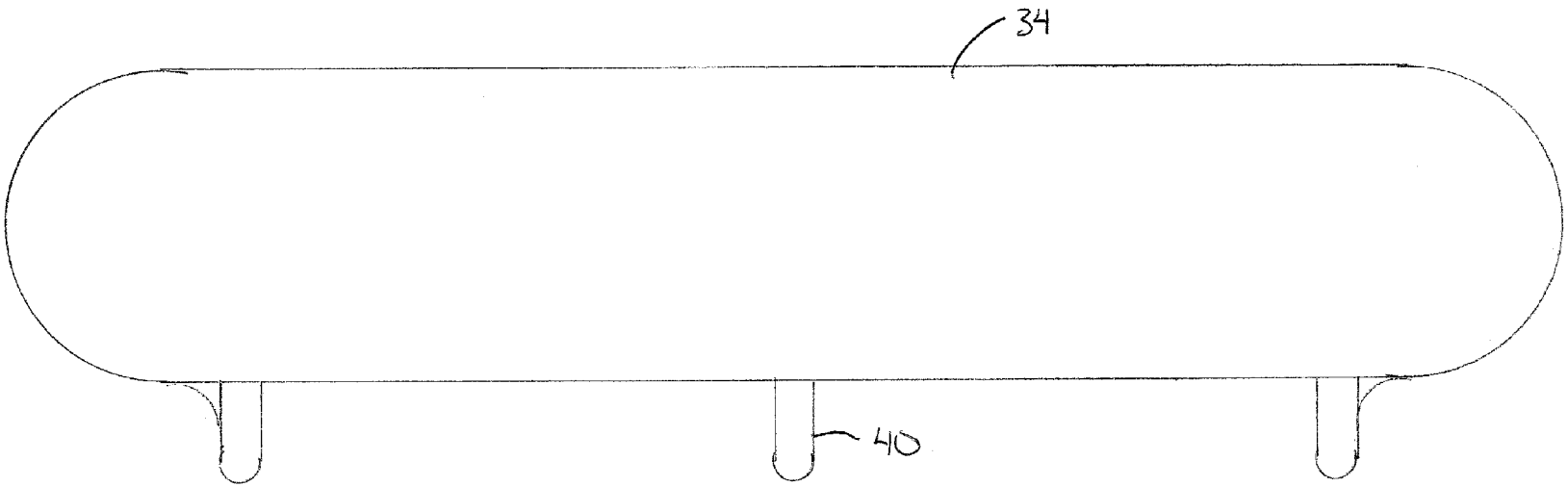
FIG. 7 is a plan view of one of the hatch covers.
Figure 8:
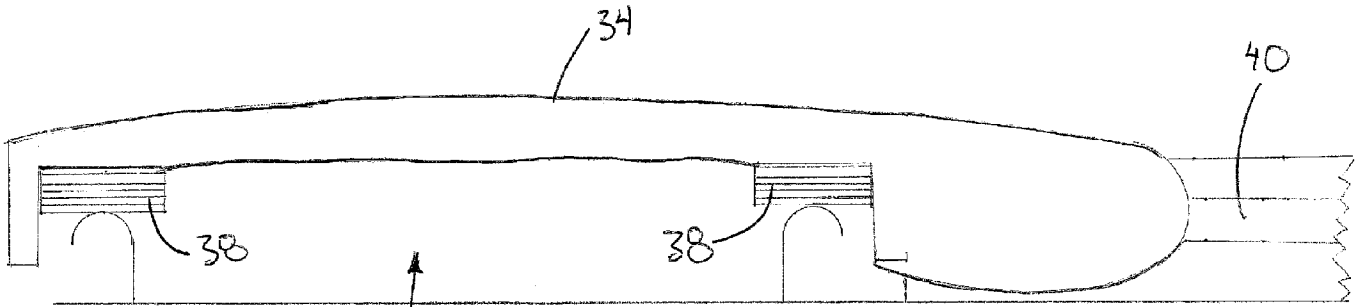
FIG. 8 is a sectional view of one of the hatch covers shown in a closed position.
Figure 9:
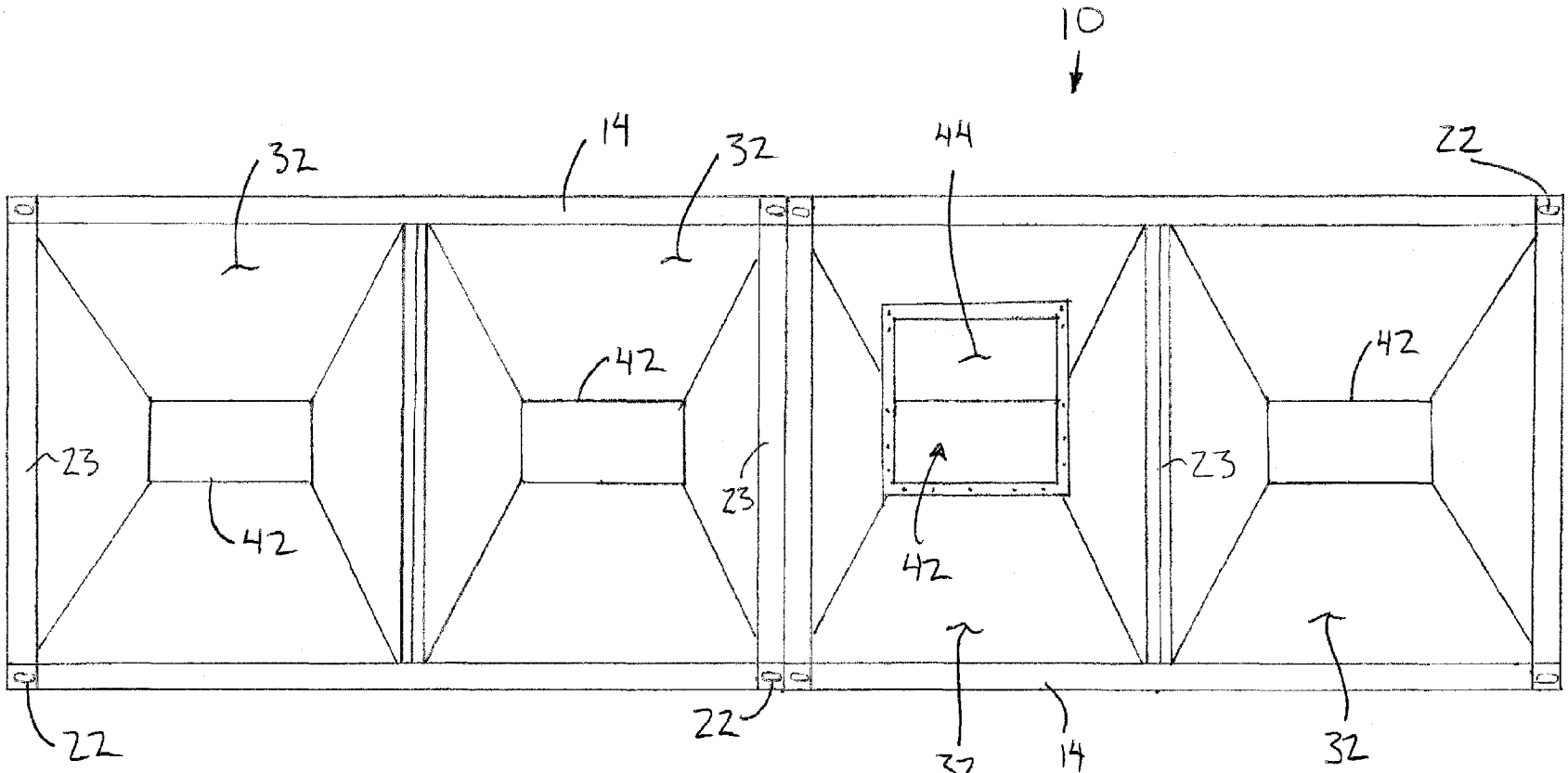
FIG. 9 is a bottom plan view of the container according to FIG. 1.
Figure 10:
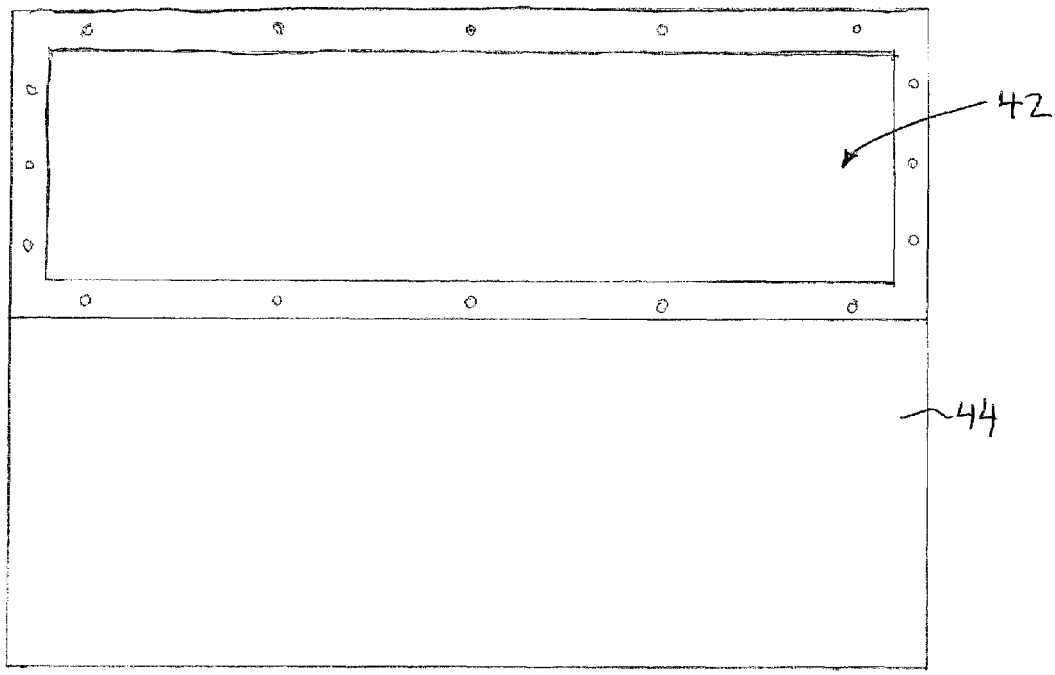
FIG. 10 is an enlarged plan view of one of the hopper discharge gates.
Figure 11:
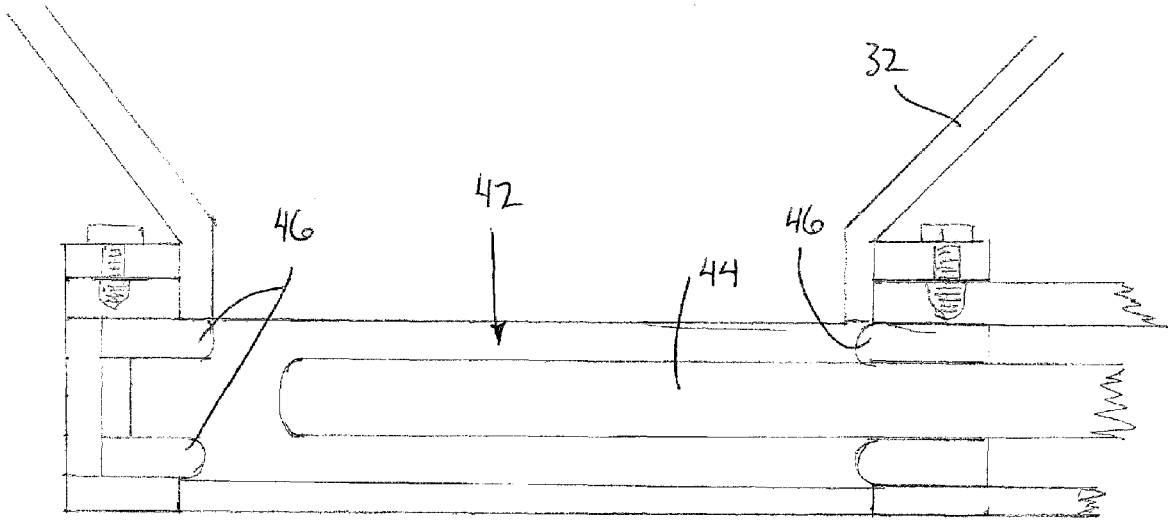
FIG. 11 is a sectional view of one of the hopper discharge gates.

Referring to the accompanying drawings, there is illustrated a hopper/freight/intermodal container generally indicated by reference numeral 10. The container 10 is particularly suited for both the movement of bulk granulated product and for the shipping of pallet freight. This container used by the shipping and transport industry for being handled similarly to conventional intermodal containers. These containers are stackable and used in the industry on trucks, intermodal railcars and shipping companies.

The container 10 has a rectangular frame 12 which fully surrounds the container so that it is suitable for being supported in a stacking configuration or on a generally horizontal supporting surface. Each frame includes two bottom rails 14 which are parallel and spaced apart along opposing sides of the container along the bottom thereof.

The two top rails 16 are similarly parallel and spaced apart from one another along opposing sides of the top side of the container. Corner posts 18 join the top and bottom rails. A plurality of side posts 20 span between the top and bottom rails, parallel to the corner posts at spaced position along respective sides of the containers. The rails used forming the structure of the frame 12 each comprise an angle formed of two perpendicular flanges to provide suitable strength to the frame. The corner posts 18 and side posts 20 forming the structure of the frame 12 each comprise tubular material to provide suitable strength to the frame.

Corner and center connectors 22 are provided at each of the top and bottom ends of the posts 18 and 20 to permit the containers to be interlocked with one another when stacking similarly to conventional box-type intermodal containers. The frame further includes cross bars 23 which extend between the bottom rails 14 at spaced positions therealong and at respective ends thereof and similarly span the top rails 16 at spaced position therealong and at respective ends thereof. The cross bars are similarly formed of an angle comprising two perpendicular flanges and are similarly interconnected between the corners and center connectors 22.

Figure 12:
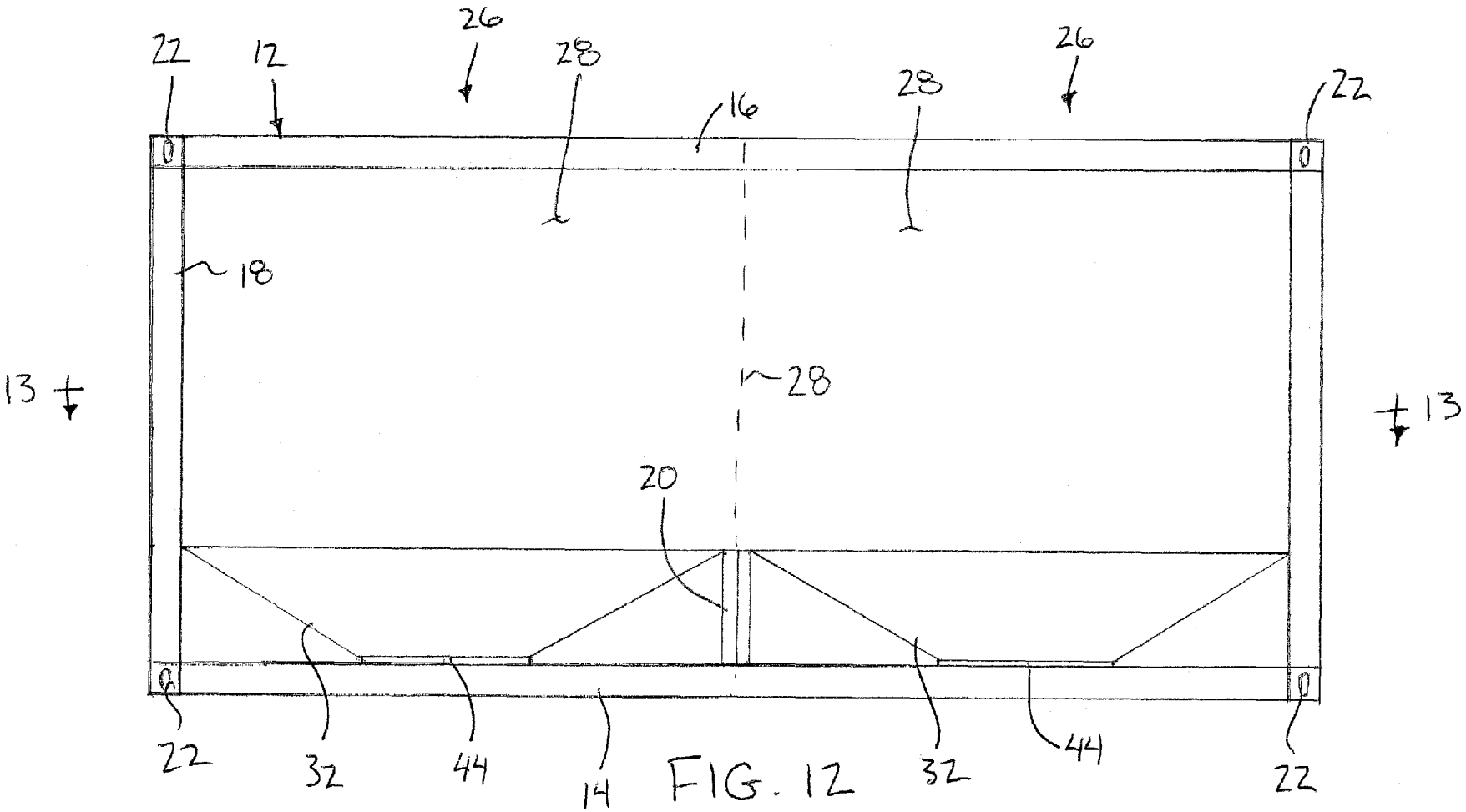
FIG. 12 is a side elevational view of a second embodiment of the container.
Figure 13:
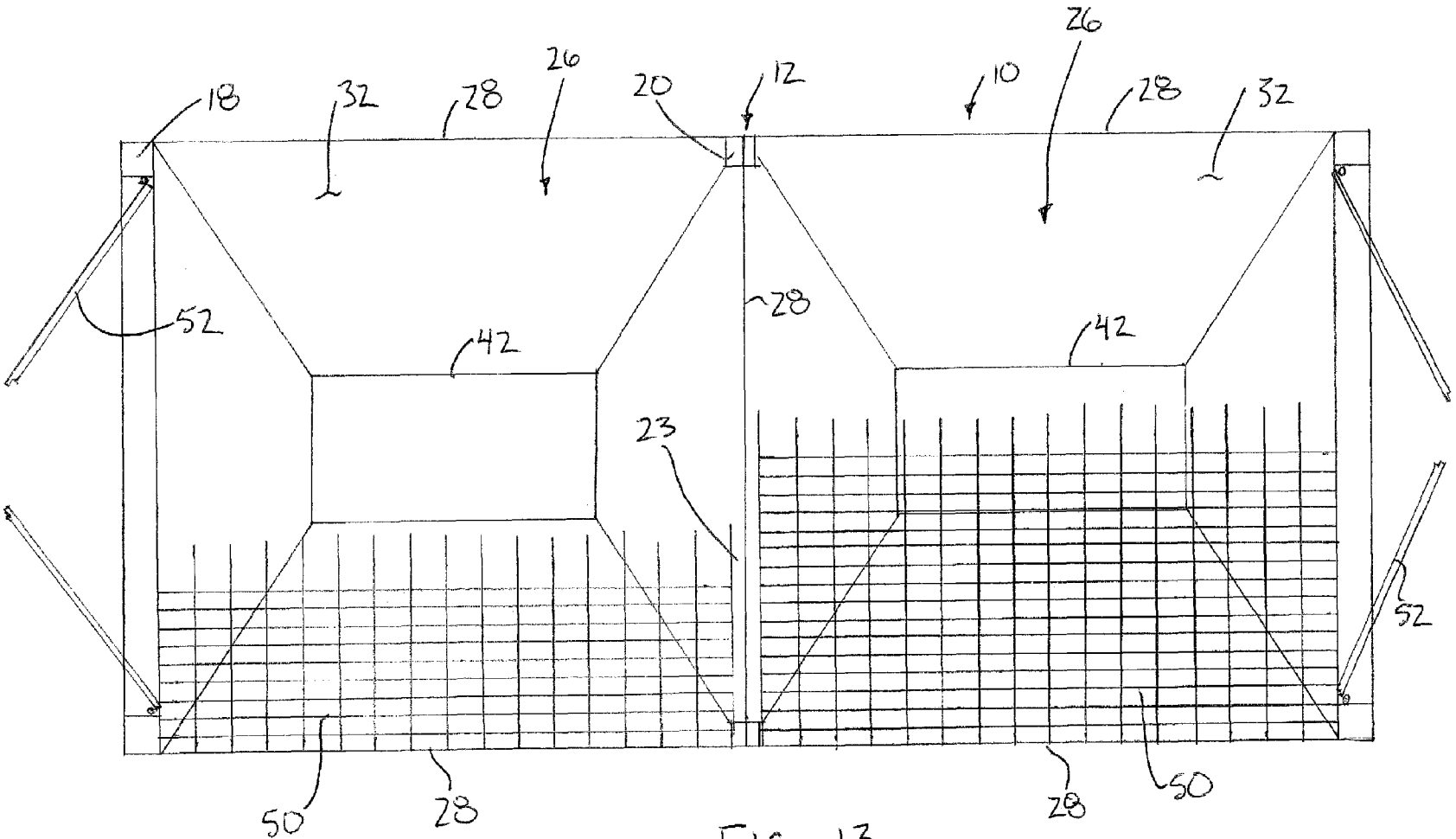
FIG. 13 is a sectional view along the line 13-13 of FIG. 12.

The interior volume of the container is divided into a plurality of separate compartments 26. The compartments are aligned sequentially with one another in the longitudinal direction between the opposed ends of the container 10. Each compartment therefore extends a full width of the container and a full height of the container but only a portion of the length of the container in the longitudinal direction. As shown in the embodiment of FIG. 1, when the container comprises a standard forty foot long intermodal container, the container is preferably divided into four equal compartments in the longitudinal direction. Alternatively, when the container comprises a standard dimensioned twenty foot length intermodal container as shown in FIG. 12, preferably only two compartments divide the container in the longitudinal direction.

Each compartment 26 includes four side walls 28 which extend substantially vertically between a top wall 30 adjacent a top end of the container and a hopper 32 forming a bottom of each compartment 26 adjacent the bottom end of the frame 12. The side walls 28 of each compartment are spaced outwardly at the outer perimeter of the frame 12 so that each compartment is substantially rectangular in cross section and occupies a maximum volume within the volume bound by the frame 12.

The top wall 30 is located adjacent the top of the frame 12, but is spaced downwardly slightly below the top rails 16 sufficiently to provide space for a hatch cover 34 which selectively encloses a hatch opening 36 formed in the top of each compartment for access to the hollow interior thereof. The hatch openings 36 and the respective hatch covers 34 are elongate in the longitudinal direction of the container and are centered between opposing sides of the container. Seals 38 are provided to fully seal the hatch openings closed when the hatch covers are in the closed position. A linkage 40 is coupled between the top wall 30 and each hatch cover 34 for controlling movement of the hatch cover between open and closed positions. The linkages 40 and the hatch covers 34 are suitably designed to ensure that the hatch covers and linkages remain fully within a volume defined by the perimeter of the frame as they are displaced between respective open and closed positions.

The hopper 32 at the bottom of each compartment is low in profile and fully spans the bottom of the side walls 28 to ensure that all material within the respective compartment falls down onto the hopper 32 which is sloped downwardly and inwardly to a discharge opening 42 centrally located relative to the respective compartment 26. A suitable gate 44 selectively spans the discharge opening 42. The gate and respective discharge opening 42 of each compartment are also elongate in the longitudinal direction and are provided with suitable seals 46 to ensure that the gates are maintained in an airtight condition when closed. A suitable linkage 48 is provided coupled between the frame and each gate 44 for controlling movement of the gates between respective open and closed positions. The gate and corresponding linkage of each compartment 26 is suitably arranged such that both the gate and the linkage remain fully contained within the volume bounded by the frame of the container as they are displaced between respective open and closed positions. The gate 44 along with the respective linkage 48 is supported on a frame which bolts onto the bottom of the respective hopper 32 for ease of replacement if broken.

When multiple compartments are provided in sequence along the length of the container, interior ones of the side walls 28 comprise a common wall dividing two compartments. In some embodiments interior ones of the side walls 28 which form dividers between adjacent compartments may be removed for ease of access to the interior and for shipping larger pallet type freight to span multiple compartments.

In order to support the pallet type freight, a floor 50 is provided which spans horizontally between the opposed side walls 28 of each compartment 26. The floor 50 is located at the bottom of the vertical portion of the side walls 28 immediately above the respective hopper 32 which tapers inwardly towards the discharge opening 42. The floor 50 of each compartment thus comprises a rectangular member which is sufficiently rigid for supporting pallet loads thereon. The floor 50 is formed of a grate or other suitable material having a plurality of through openings therethrough so as not to restrict particulate material from falling therethrough onto the hopper discharge at the bottom of the compartment. Structural beams connected to the frame 12 of the container are provided as required for supporting the floor 50 to span the side walls in a horizontal orientation. The floors 50 of adjacent compartments are level with one another so that if interior ones of the side walls 28 are removed, the floors form a continuous supporting surface for pallet loads.

Doors 52 are provided in association with each compartment 26 to provide access to pallet loads onto the floor of the compartment. Compartments 26 at the opposed longitudinal ends of the container are provided with doors 52 which fully span the side walls 28 located at the respective ends of the container. Each set of doors 52 comprises two door panels which are hinged along vertical hinges at opposing sides of a door opening so that the door panels meet at a center of the opening where suitable latches 54 are provided for locking the door panels closed in a sealed configuration spanning the door openings of the respective compartments.

Intermediates ones of the compartments 26 located between the opposed ends are each provided with a set of doors 52 in one of the side walls of the container. In each instance the doors 52 span a full width of the respective compartment and span a full height of the compartment between the top wall 30 and the hopper 32 at the bottom so that the side wall 28 at each door location is substantially fully replaced with a door opening of similar dimension to the set of doors 52 which spans the door opening when closed. Due to location of the floor 50 directly above the respective hopper 32 of each compartment, the doors 52 accordingly span a full height between the floor 50 and the top wall 30. When interior ones of the side walls 28 are removed so that compartments 26 within the interior are open to one another, door sets are not required at the side walls of the container, but may instead be only provided at the ends of the container.

Each of the containers has a height ranging from a standard 8 feet to 9 feet 6 inches and is 8 ft wide. The embodiment of FIG. 1 is 40 feet in length and the embodiment of FIG. 12 is 20 feet in length. The containers are standard to all ISO containers for domestic and international service and allow for bulk and dry service. The hatches are 2 ft wide and 4 ft long. The gates are 1 foot 6 inches wide and 3 feet long. The gates and hatches are vertically aligned with one another for aligning each gate with the hatch of an adjacent container of identical configuration stacked therebelow. The top roof is 6 inches from the top and the bottom gate is approximately 6 inches from the ground. The unit is suitable for carrying 20 metric tons of grain or granulated products.

As described herein an intermodal container is provided comprising: at least one or more compartments including: a hopper formed at a bottom end of said at least one or more compartments which tapers downwardly and inwardly to a chute opening; a gate member which selectively closes the chute opening of said at least one or more compartment; a hatch opening at the top of said at least one or more compartment which is selectively covered by a hatch cover; a set of doors at the end or side of said at least one or more compartment which selectively opens and closes for loading and unloading; a flow-through floor which allows granulated product to fall through and supports pallet type freight thereon; and a frame surrounding the hopper of said at least one or more compartment for supporting on a generally horizontal supporting surface. Said at least one or more compartment comprises a plurality of compartments each having a respective gate member, hatch cover and end/side doors. The frame extends along a full rectangular perimeter about the hopper container. The gate member, the hatch cover and the doors are fully contained within an area/volume bound/defined by the frame. The gate member opening and hatch cover opening of said at least one or more compartment are in vertical alignment with one another. When the container is supported on a container carrying railcar having a deck upon which the frame of the container is supported, the hopper of said at least one or more compartment of the container is supported above the deck of the railcar.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A multi-use intermodal container comprising:

a rectangular frame suitably sized and configured for stacking with conventional intermodal containers;

a plurality of compartments supported on the frame, each compartment comprising:

a top wall enclosing a top side of the compartment and locating a hatch opening therein;

a hatch cover for selectively closing the hatch opening;

a hopper enclosing a bottom side of the compartment, the hopper tapering downwardly and inwardly to a discharge opening;

a gate for selectively closing the discharge opening;

upright side walls extending between the hopper and the top wall;

and a floor spanning generally horizontally between the side walls above the hopper for supporting a load thereon, the floor being arranged to allow passage of particulate material therethrough; and at least one door supported in a respective one of the side walls of each compartment so as to be arranged for access to a hollow interior of the compartment.

2. A container according to claim 1 wherein the floor comprises a grate including a plurality of through openings formed therein.

3. The container according to claim 1 wherein the floor spans between a bottom of the side walls and the hopper is located immediately below the floor.

4. The container according to claim 1 wherein the side walls extend substantially vertically upward from the floor.

5. The container according to claim 1 wherein said at least one door extends upwardly from the floor.

6. The container according to claim 1 wherein said at least one door is fully contained within a volume defined by a perimeter of the frame.

7. The container according to claim 1 wherein each compartment is rectangular in cross section.

8. The container according to claim 1 wherein said at least one door includes a door supported at each end of the frame.

9. The container according to claim 1 wherein there are provided four compartments sequentially aligned with one another in a longitudinal direction of the frame and wherein said at least one door includes doors located along sides of the container which are associated with interior ones of the compartments.

10. The container according to claim 1 wherein the frame extends along a full rectangular perimeter about the hopper of each compartment.

11. The container according to claim 1 in combination with a container carrying railcar having a deck upon which the frame of the container is supported and wherein the hopper of each compartment is supported above the deck of the railcar.

12. The container according to claim 1 wherein the upright side walls include interior ones which form dividers between adjacent ones of the compartments.

13. The container according to claim 12 wherein the interior ones of the upright side walls are readily removable.

14. The container according to claim 1 wherein the doors span a full height and a full width of the respective compartments.

* * * * *